United States Patent [19]

Travor et al.

[11] Patent Number: 5,052,270

[45] Date of Patent: Oct. 1, 1991

[54] MULTI-SONOBUOY LAUNCH CONTAINER WITH CONSTANT FORCE SPRING

[75] Inventors: Bruce W. Travor, Holland; Richard M. Coughlan, Warminster; Edward J. Cotilla, Churchville; Frank P. Marshall, Penns Park, all of Pa.

[73] Assignee: The United States of America as represented by the Secretary of the Navy, Washington, D.C.

[21] Appl. No.: 544,295

[22] Filed: Jun. 20, 1990

[51] Int. Cl.[5] ..... B64D 1/12; F41F 5/00

[52] U.S. Cl. ..... 89/1.51; 244/137.4

[58] Field of Search ..... 244/137.1, 137.4, 118.1; 89/1.51, 1.56, 1.57

[56] References Cited

U.S. PATENT DOCUMENTS

| | | | |
|---|---|---|---|
| 2,608,131 | 8/1952 | Pearce | 89/1.57 |
| 2,707,904 | 5/1955 | Strunk et al. | 89/1.51 |
| 3,618,450 | 11/1971 | Fink et al. | 244/137.4 |
| 3,787,012 | 1/1974 | Jakubowski, | 244/137.4 |
| 3,967,506 | 7/1976 | Billot | 89/1.51 |
| 4,164,887 | 8/1979 | Ouellette | 89/1.51 |
| 4,397,433 | 8/1983 | Guitaut et al. | 244/137.4 |
| 4,560,228 | 12/1985 | Bender | 89/1.51 |

*Primary Examiner*—David H. Brown

*Attorney, Agent, or Firm*—James V. Tura; James B. Bechtel; Susan E. Verona

[57] ABSTRACT

A multi-store, mechanically-actuated launcher is disclosed. Negator springs put constant pressure on sequentially-stack stores inside a launch container and an electro-mechanical gate releases one store after another upon initiation of an electrial impulse from the transporting vehicle.

11 Claims, 4 Drawing Sheets

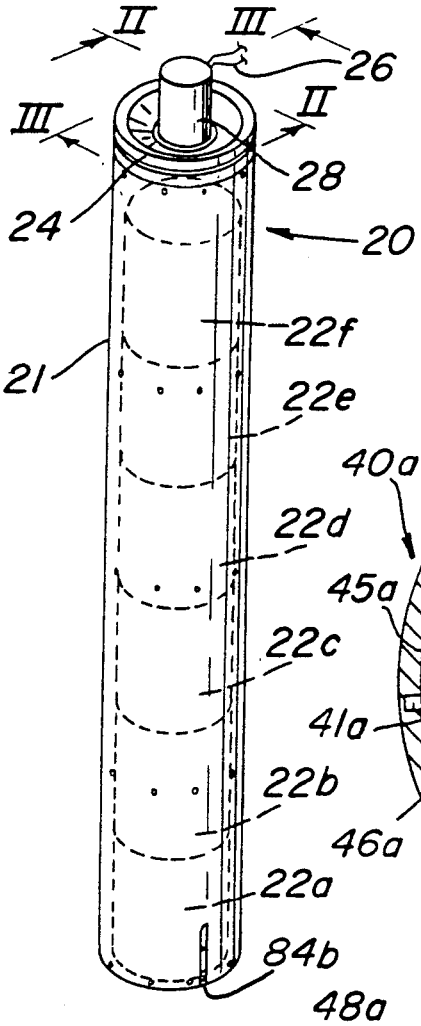
FIG. 1
FIG. 4
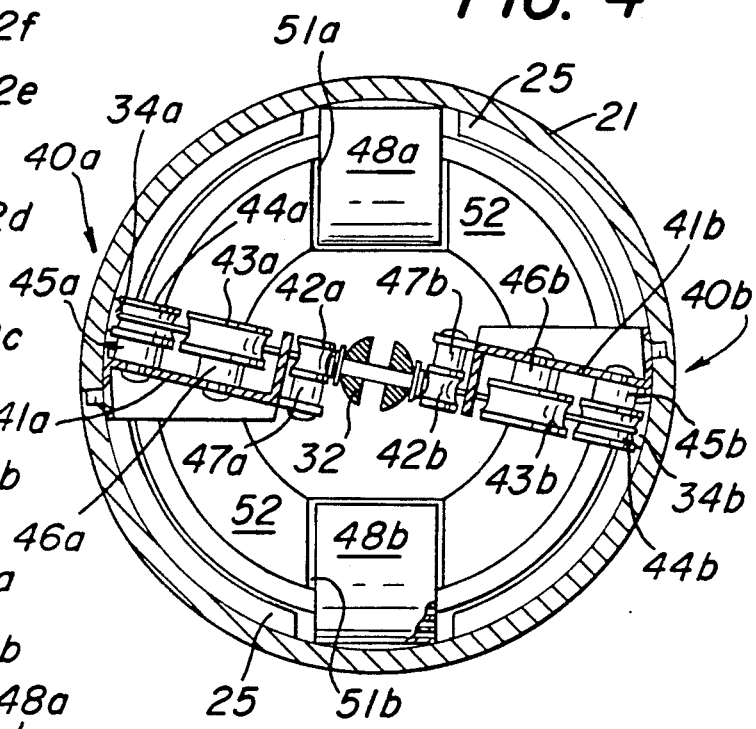
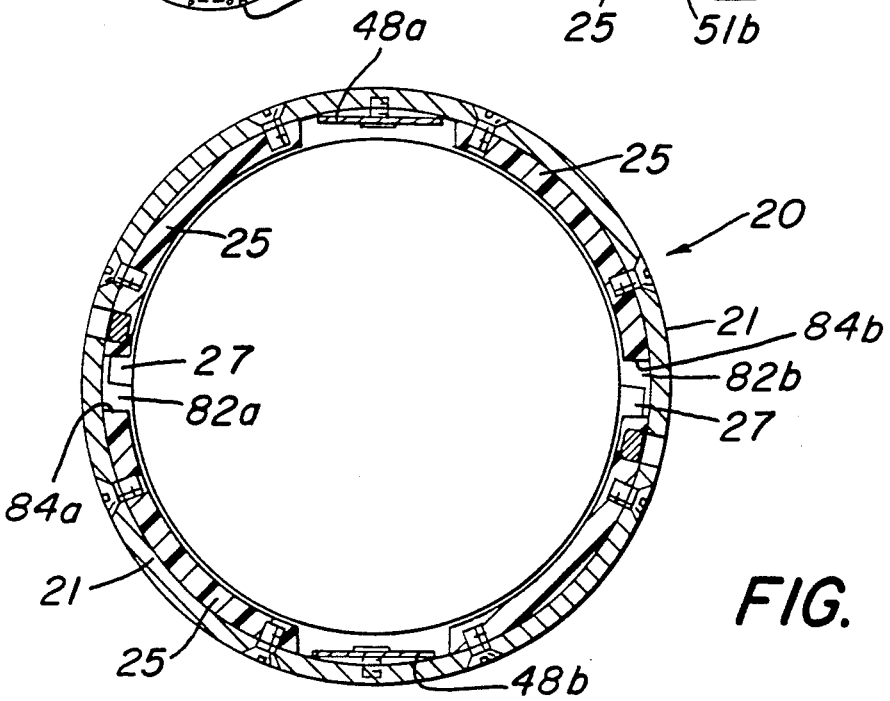
FIG. 7

ELECTRONIC CONNECTION
28
28
AIRCRAFT STRUCTURE
23
23
48b
32
32
IV
IV
48a
48b
52
52
25
21
34a
34b
22f
22f
27
25
27
48b
21
22e
22e 34a
34b
27

22b
22b
48a
22a
22a
27
VII
VII
AIRCRAFT STRUCTURE

MULTI-SONOBUOY LAUNCH CONTAINER WITH CONSTANT FORCE SPRING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention discloses an electronically-actuated, multi-store dispenser wherein a constant force spring causes sequential launching of stores from their tandem position inside a launch container. In some environments, it is desirable to dispense multiple stores from a launch vehicle, for instance sonobuoys, in dense patterns. Due to physical limitations of space in the dispensing vehicle, an effort was made to miniaturize the active components inside the store and therefore reduce the overall outer dimensions thereof. Once the size of the store was reduced, in order to meet the demands of the denser patterns, the inside of the individual launch containers were modified to allow each to hold and dispense more than one store. This new type of launch container, in addition to maintaining the size requirement dictated by the transporting vehicle, is operated by the vehicle's electrical systems.

SUMMARY OF THE INVENTION

A multi-store launcher, that utilizes a constant force pressure on a stack of sonobuoys coupled with an electronically-controlled gate bar, is disclosed. The constant force, which can come from a biasing means, such as springs, urges the stack of sequentially-positioned stores to attempt to exit at the discharge end of the container. Upon an electronic signal from the transporting vehicle, a solenoid activates a clevis, or shackle, which, in turn, raises the gate bar for a brief period. The lower-most store is forced out of the container and ears on the next lowermost store are caught at the closed gate bar. These actions are repeated until all the sonobuoys are launched.

The primary object of the present invention is to provide a multi-store launcher wherein constant force is exerted on a stack of stores to launch each store with equal exit velocity.

Another object of the invention is to provide a multi-store launch container for launching, sequentially, a plurality of stores wherein said container is adaptable to presently existing transporting vehicles.

Still another object of the present invention is to provide a multi-store launch container wherein an electronic pulse from the transporting vehicle releases a gate that has been blocking the exit of individual stores.

Other objects, advantages and novel features of this invention will become apparent from the following detailed description when considered in conjunction with the accompanying drawings.

BRIEF DESCRIPTION OF THE DRAWINGS

FIG. 1 shows a perspective view of a modified standard-size sonobuoy launch container with a plurality of sonobuoys (shown in phantom outline) contained therein;

FIG. 4 shows a lateral cross-sectional view, taken along lines IV—IV of FIG. 2;

FIG. 7 shows a lateral cross-sectional view taken along lines VII—VII of FIG. 2.

DETAILED DESCRIPTION OF THE PREFERRED EMBODIMENTS

Figures 2, 3:
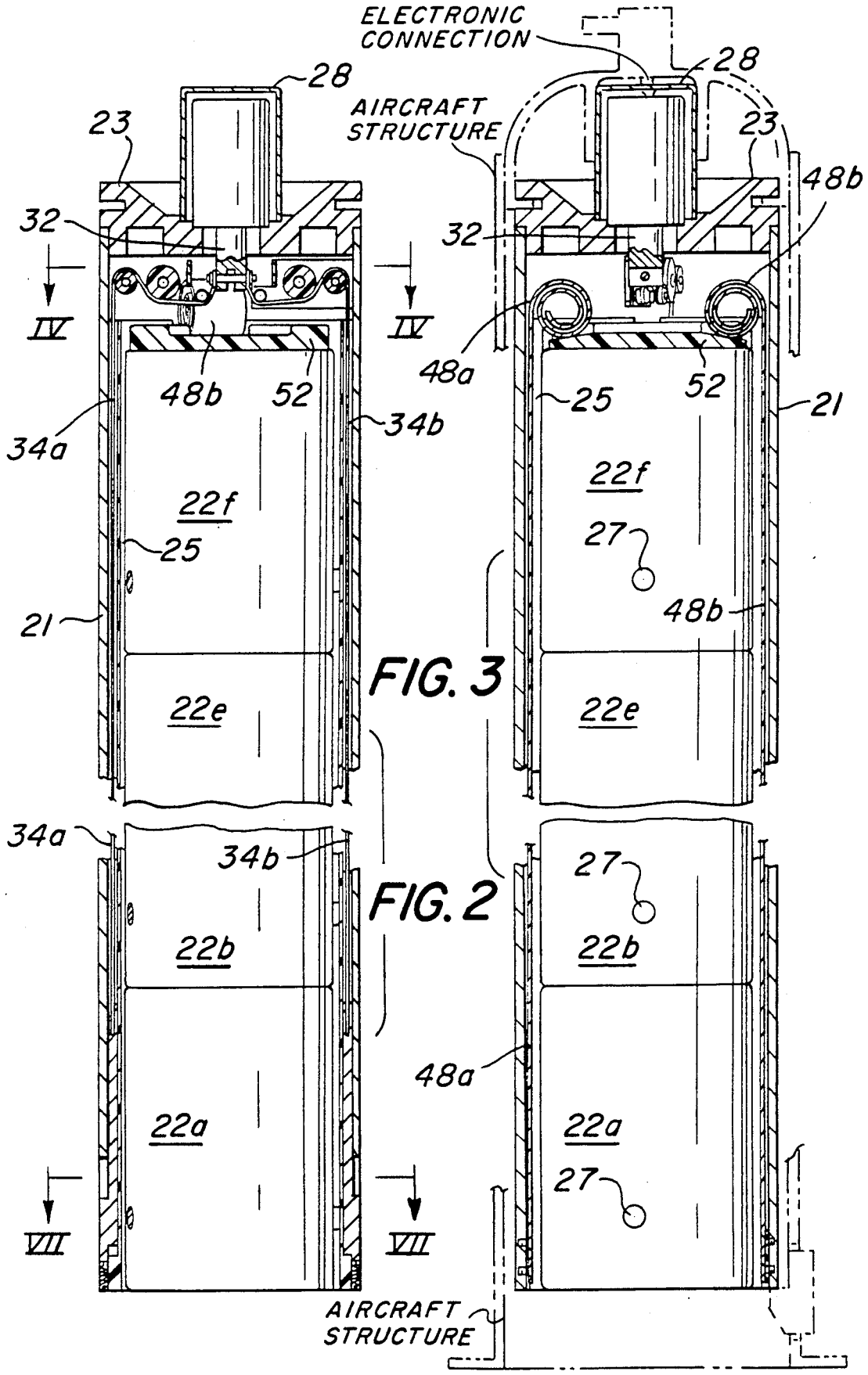
FIG. 2 shows a longitudinal cross-sectional view, taken along lines II—II of FIG. 1.
FIG. 3 shows a longitudinal cross-sectional view, taken alongs lines III—III of FIG. 1.
Figure 5:
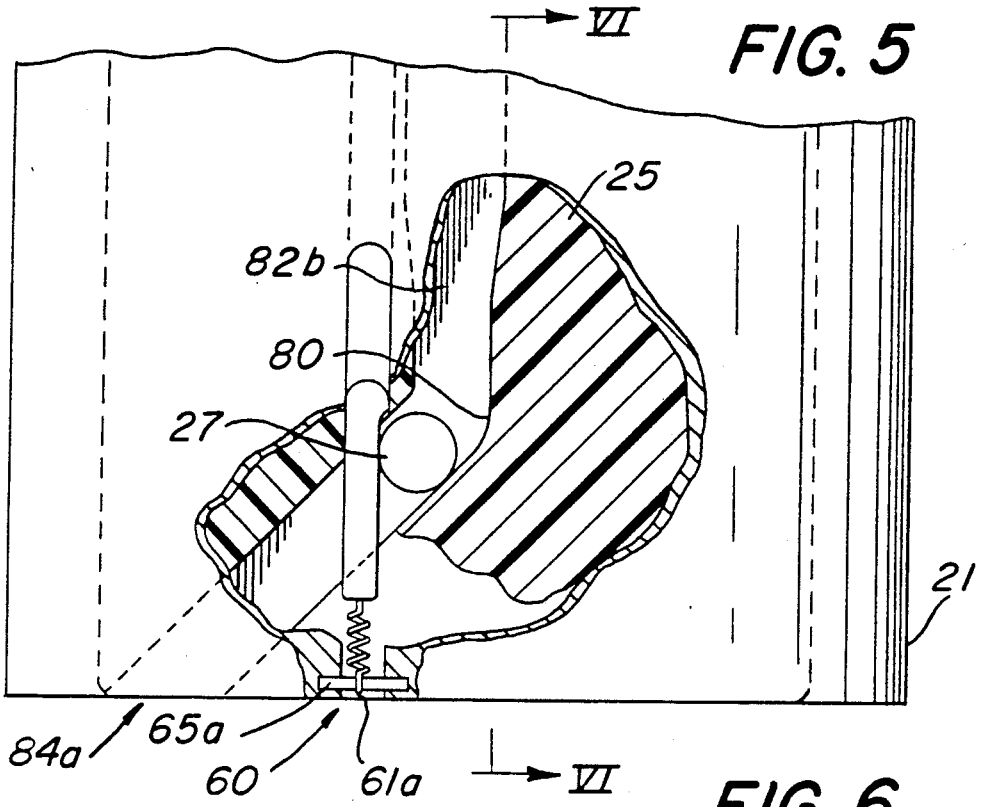
FIG. 5 shows an enlarged, partially broken away, detailed view taken at the lower section of the container of FIG. 1.
Figure 6:
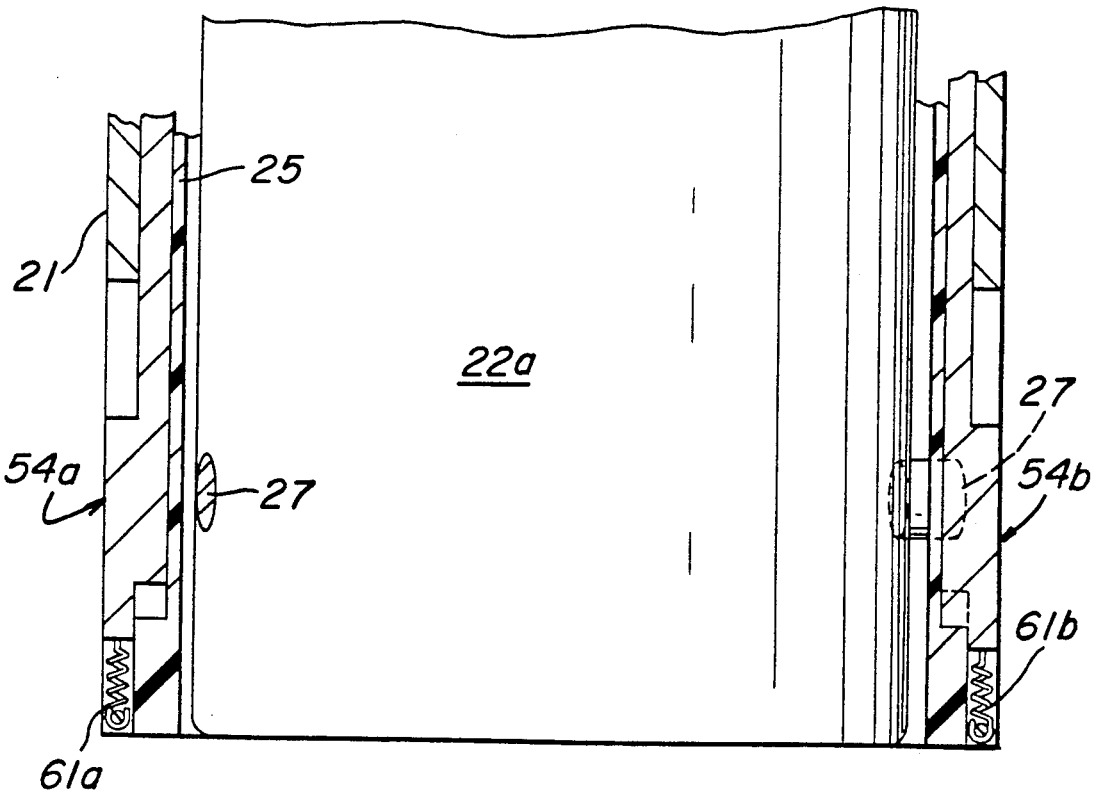
FIG. 6 shows a sectional view taken along lines VI—VI of FIG. 5.

The instant invention makes use of presently-existing, standard-sized launch containers that are capable of dispensing only one store, such as a sonobuoy, at a time and constant force negator springs, that apply launch pressure to a stack of miniature stores placed in the container, as shown at 20 in FIG. 1, to allow operations that require multiple store dispensing. Container 20, also as seen in FIGS. 2 and 3, is comprised of a tubular outer skin 21 joined at the breech end thereof to a securing cap 23 with circular lugs 24 and concentrically, semi-circular arranged inner skin sections 25, as seen at FIGS. 4 and 7. A plurality of sequentially stacked stores 22*a–f* (as seen in phantom in FIG. 1) rest inside skin 25. Tubular skin 21 and skin sections 25 can be made from any number of suitable materials, such as ABS plastic or the like, and are joined to cap 23 by "jam-fitting", or such other techniques known in the art. Cap 23 and lugs 24 are made to standard sizes to insure capatibility with vehicles, such as aircraft, that transport the launchers. Electrical leads 26 bring electrical power from a transporting aircraft to a solenoid 28, which has been affixed into cap 23 at the axial center thereof, in place of the commonly used CAD (cartridge-actuated device). Solenoid 28 is a negative-action, or "pull-in" type solenoid, which, as is known, withdraws its tongue for a short duration of time upon receiving a pulse of power from the vehicle. Attached to the solenoid tongue (not shown) by standard means is a clevis, or shackle, 32, to complete the control section of the invention.

As seen in FIGS. 2 and 4, a pair of non-elastic and non-deformable cables 34*a*,34*b* are attached to clevis 32 and extend, through pulley systems 40*a*,40*b* respectively, in between outer skin 21 and inner skin 25, the length of container 20 to gate means 54*a*,54*b* respectively. Each pulley system 40*a,b* has a "Z-shaped" bracket 41*a,b* attached to the inner surface of outer skin 21 to radiate inwardly towards the center of container 20. Each bracket carries, for rotational use, a series of pulleys 42*a*, 42*b*, 43*a*, 43*b*, 44*a* and 44*b*, attached through spacers 45, 46, and 47, respectively, as is known, and cables 34*a*,34*b* extend from clevis 32 beneath pulleys 42 and 43 and over pulley 44. Cables 34*a*,34*b* further are slidingly threaded along oppositely-situated channels (see FIG. 2) between outer skin 21 and inner skins 25 to attachment points on oppositely-disposed gate means 54*a*,54*b*.

As can be seen from FIGS. 3 and 4, a pair of negator springs 48*a*,48*b* extend from anchoring means, such as screws 49*a*,49*b*, respectively, at opposite sides of the discharge end of container 20, along the inside of skin 21 to fit into oppositely-placed spring grooves 51*a*,51*b* in obturator 52. Obturator 52 provides a releasable seal that conforms to the inner periphery of container 20 and that slidingly moves along inner skin 25, under the constant force pressure from springs 48, as each attempts to recoil, as each store is dispensed.

FIGS. 5–8 clearly show how the gate means 54 and the decelerator means 80 work, in conjunction with the stack of stores 22*a–f*, to block exit of the outermost store, release just the outermost store and control the shifting of position of remaining stores after the outermost has been dispensed. Each individual store, for example 22*a*, has oppositely-extending ears 27 (see FIG. 7), protruding in a perpendicular manner from approximately the mid-section thereof. Ears 27 slidingly fit into exit pathways 82*a*,82*b* carved out of inner skin sections 25 and control the exit of each store from container 20. Pathways 82 are arranged on opposite sides of section 25 and extend longitudinally from the breech end a predetermined distance until changing course to turn, at an angle of between forty and eighty degrees, to reach an opening 84*a*,84*b* in the bottom edge of the discharge end.

Pathways 82 are of a predetermined width larger than the diameter of ears 27 throughout the longitudinally extending section until just above decelerator means 80, where the width is decreased at a predetermined angle so that each pathway is made more narrow. This constricted area in pathways 82 tends, through the increased frictional resistance to ears 27 sliding therealong, to slow down the movement of a particular store as it reaches that specific location in container 20. Further, since an angled curve is formed at the bottom end of the longitudinally-extending portion of pathways 82, when ears 27 travel into this part, a second deceleration of the store movement takes place.

Figure 8:
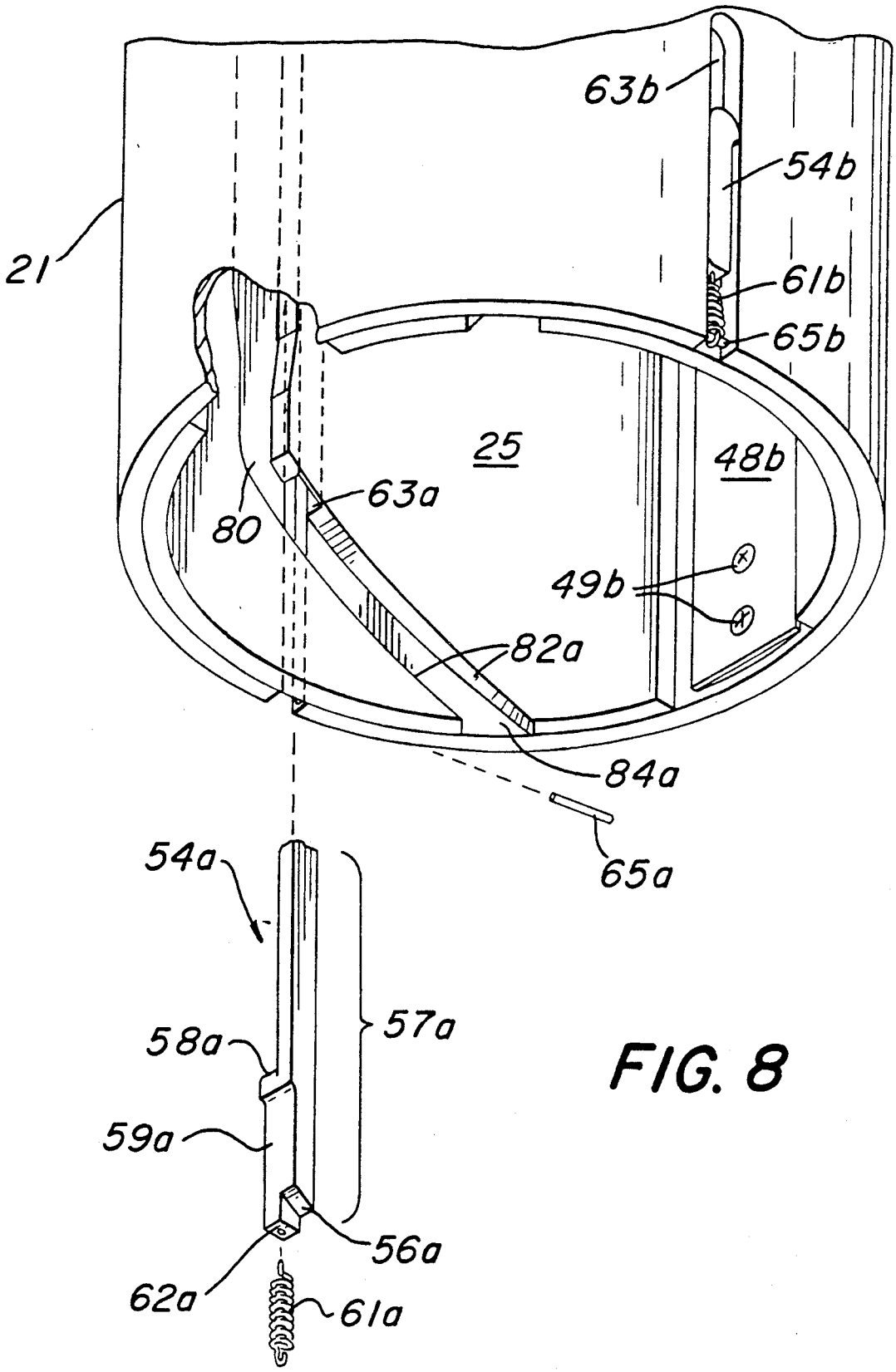
FIG. 8 shows an enlarged and exploded perspective view of the empty discharge end of the launch container.

Slidingly fitting into longitudinally-extending chutes 63*a*,63*b* are gate means 54*a*,54*b*. Each gate is comprised of an elongated, double thickness bar with a proximal and a distil end and having a bevelled edge 56*a*,56*b* at the distil end of a first thickness 57*a*,57*b* and an oppositely-disposed curved proximal end 58*a*,58*b* on the other thickness 59*a*,59*b*. Additionally, a return spring 61*a*,61*b* is attached to the distil end 62*a*,62*b* of the second thickness by pins 65*a*,65*b* for a purpose to be described. As can be seen in FIG. 8, chutes 63*a*,63*b* extend into both outer skin 21 and inner skin sections 25 to provide a multi-planar area for gate means 54*a*,54*b* to move in.

OPERATION

The herein described invention allows the dispensing of a plurality of stores 22*a–f* from a standard size launch container 20 physically joined to a transporting vehicle after connecting electrical power from the vehicle thereto. Negator springs 48*a*,48*b*, through the constant pressure or force on stores 22*a–f*, provide the propulsion force necessary to accelerate each store to a desired exit velocity within the time of a stroke length of clevis 32. As solenoid 28 is actuated, clevis 32 pulls in on cable 34, which is connected, through pulley systems 40, to gate means 54. As power is applied, means 54 is moved from a position where thickness 57 blocks any movement by ears 27 to a release position where bevelled edges 56 clear pathways 82. The electric pulse to solenoid 28 is timed to allow the force from negator springs 48 to eject only one store, or, in other words, to allow only one set of ears 27 to clear gate means 54. Once the ears of the outermost store starts to move along the angled portion of pathway 82, the ears of the store immediately next to it slide down the longitudinal section of pathway 82 until they reach the decelerating means 80. Means 80, both the constricted area and the angle in pathway 82 slow the movement of this next store down sufficiently to allow, after the electric pulse ends, the first thickness 57 to be returned by force from return springs 61 to block the exit of any more stores. Subsequent stores are all dispensed in like manner, with the coils from negator springs 48 always forcing themselves against obturator 52.

Obviously many modifications and variations of the present invention are possible in light of the above teachings. It is therefore to be understood that within the scope of the appended claims the invention may be practiced otherwise than as specifically described.

What we claim is:

1. A multi-store launch container carried by a vehicle and electronically connected to said vehicle and adapted to carry and sequentially release multiple stores, comprising:

a. a container, having a breech end connected to a vehicle and an oppositely-disposed discharge end, and being filled with a plurality of stores for sequential release through a pathway at the discharge end;

b. constant force biasing means applied against the innermost of said stores to attempt to force said stores through the discharge end;

c. gate means releasably fixed at the discharge end to alternatingly obstruct and allow the exit of a store; and d. electronically-actuated control means connected to the vehicle and said gate means to provide reciprocating motion to said gate means.

2. A multi-store launch container as described in claim 1 wherein said control means comprises an electronically-actuated solenoid having a clevis connected to its operating arm.

3. A multi-store launch container as described in claim 1 wherein said constant-force biasing means comprises negator springs means anchored at the discharge end of the container and coiled adjacent the innermost store to place constant pressure on said plurality of stores.

4. A multi-store launch container as described in claim 3 wherein said negator spring means comprises at least two negator springs.

5. A multi-store launch container as described in claim 1 wherein said gate means includes slidable and biased release means located in the exit pathway of the stores to alternate between a blocking position and a non-blocking position, to release or allow passage of, respectively, the stores, connector means along the periphery of the container for joining said control means to said release means, and decelerator means located in the pathway of the stores to reduce the exit velocity of stores remaining in the container subsequent to a launch.

6. A multi-store launch container as described in claim 5 wherein said release means comprises a pair of longitudinally-extending and multi-layered bars located in the exit pathway and spring-biased to prevent the exit of the outer-most store.

7. A multi-store launch container as described in claim 5 wherein said connector means includes non-deformable wires connected to said release means, riding on a plurality of pulleys and connected to said control means.

8. A multi-store launch container as described in claim 5 wherein said decelerator means comprises exit pathways having a bend of a predetermined angle therein.

9. A multi-store launch container as described in claim 8 wherein said predetermined angle is between approximately forty and eighty degrees.

10. A multi-store launch container as described in claims 1 or 9 wherein said container is tubular.

11. A multi-store launcher carried by a vehicle and electronically connected to said vehicle to dispense, sequentially, a plurality of stores, comprising:

a. a tubular container for attaching to a vehicle having a proximal, breech end, connected to the vehicle and a distil, discharge end, and being filled with a plurality of stores;

b. at least two negator springs anchored at the discharge end of said container and coiled against the innermost of the plurality of said stores;

c. at least two release gates slidably fixed at the discharge end of the container and removably blocking release of the outmost of said plurality of stores;

d. a negative-action solenoid connected to the breech end and electrically connected to the vehicle; and e. non-elastic cable connected between said solenoid and said release gates.

* * * * *